US007230379B2

(12) United States Patent
Kwon et al.

(10) Patent No.: US 7,230,379 B2
(45) Date of Patent: Jun. 12, 2007

(54) PLASMA DISPLAY PANEL HAVING SHARED COMMON ELECTRODES MOUNTED IN AREAS CORRESPONDING TO NON-DISCHARGE REGIONS

(75) Inventors: Jae-Ik Kwon, Suwon-si (KR); Kyoung-Doo Kang, Suwon-si (KR)

(73) Assignee: Samsung SDI Co., Litd, Suwon-si (KR)

( * ) Notice: Subject to any disclaimer, the term of this patent is extended or adjusted under 35 U.S.C. 154(b) by 0 days.

(21) Appl. No.: 10/927,584

(22) Filed: Aug. 25, 2004

(65) Prior Publication Data

US 2005/0082978 A1 Apr. 21, 2005

(30) Foreign Application Priority Data

Oct. 16, 2003 (KR) ..... 10-2003-0072363

(51) Int. Cl.
*H01J 17/49* (2006.01)
*G09G 3/10* (2006.01)

(52) U.S. Cl. ..... 313/583; 313/582; 313/584; 313/585; 315/169.4

(58) Field of Classification Search ..... 313/582, 313/583, 584, 585; 315/169.4
See application file for complete search history.

(56) References Cited

U.S. PATENT DOCUMENTS 5,825,128 A * 10/1998 Betsui et al. ..... 313/582
5,883,462 A 3/1999 Ushifusa et al.
5,900,694 A * 5/1999 Matsuzaki et al. ..... 313/484
6,411,033 B1 * 6/2002 Mori et al. ..... 313/582
6,545,405 B1 * 4/2003 Shino et al. ..... 313/491
6,741,031 B2 * 5/2004 Harada et al. ..... 313/582
2001/0024092 A1 * 9/2001 Kim et al. ..... 315/169.4
2004/0085264 A1 * 5/2004 Takada et al. ..... 345/60
2005/0046350 A1 * 3/2005 Su et al. ..... 313/582
2005/0093449 A1 * 5/2005 Su et al. ..... 313/584

FOREIGN PATENT DOCUMENTS

JP 2000-285814 10/2000
JP 2002-190256 7/2002
KR 1997-0060306 8/1997

OTHER PUBLICATIONS

Patent Abstract of Japan, Publication No. 2000-285814, Published on Oct. 13, 2000, in the name of Shino, et al.
Patent Abstracts of Japan, Publication No. 2002-190256, dated Jul. 5, 2002, in the name of Yusuke Takada et al.

* cited by examiner

*Primary Examiner*—Nimeshkumar D. Patel
*Assistant Examiner*—Peter Macchiarolo
(74) *Attorney, Agent, or Firm*—Christie, Parker & Hale, LLP

(57) ABSTRACT

A plasma display panel includes opposing first and second substrates provided with a predetermined gap therebetween. Address electrodes are formed on the first substrate. Barrier ribs are mounted in the gap between the first and second substrates to define discharge cells. Phosphor layers are formed within each discharge cell. Sustain electrodes are formed on the second substrate along a direction perpendicular to the address electrodes. The sustain electrodes include scan electrodes and common electrodes. One scan electrode is formed for each row of the discharge cells formed along the direction perpendicular to the address electrodes, and two common electrodes are formed for each such row of the discharge cells. Furthermore, each common electrode is shared among adjacent rows of the discharge cells. The common electrodes are mounted corresponding to non-discharge regions.

16 Claims, 5 Drawing Sheets

PLASMA DISPLAY PANEL HAVING SHARED COMMON ELECTRODES MOUNTED IN AREAS CORRESPONDING TO NON-DISCHARGE REGIONS

CROSS-REFERENCE TO RELATED APPLICATIONS

This application claims priority to and the benefit of Korean Patent Application No. 2003-0072363 filed on Oct. 16, 2003 in the Korean Intellectual Property Office, the entire content of which is incorporated herein by reference.

BACKGROUND OF THE INVENTION (a) Field of the Invention

The present invention relates to a plasma display panel (PDP). More particularly, the present invention relates to an AC-PDP that forms discharge cells by including address electrodes on a rear substrate, and sustain electrodes comprised of scan electrodes and common electrodes on a front substrate.

(b) Description of the Related Art

A PDP is a display device that uses vacuum ultraviolet rays generated by gas discharge in discharge cells to excite phosphors, thereby realizing the display of images. With its ability to realize high-resolution images, the PDP is emerging as one of the most popular flat panel display configurations used for wall-mounted televisions and other similar large-screen applications.

The different types of PDPs include the AC-PDP, DC-PDP, and the hybrid PDP, depending on the voltage application method. The AC-PDP utilizing a triode surface discharge structure is becoming the most common configuration.

In the AC-PDP with a triode surface discharge structure, address electrodes, barrier ribs, and phosphor layers are formed on a rear substrate. Sustain electrodes comprised of scan electrodes and common electrodes are formed on a front substrate. A dielectric layer is formed covering the address electrodes on the rear substrate, and another dielectric layer is formed covering the sustain electrodes on the front substrate. Discharge cells are formed by the intersection of the address electrodes with the sustain electrodes, and discharge gas (typically an Ne—Xe compound gas) is filled in the discharge cells.

Using the above structure, an address voltage Va is applied between an address electrode and a scan electrode to select a discharge cell where illumination is to take place through address discharge. Next, if a sustain voltage Vs is applied between the common electrode and the scan electrode of all discharge cells, plasma discharge occurs in the selected discharge cells. Vacuum ultraviolet rays are emitted from the excited Xe atoms created during plasma discharge. The vacuum ultraviolet rays excite phosphors so that they glow (i.e., emit visible light) and thereby enable the display of predetermined color images.

In the PDP structured and operating as described above, several steps are involved between when power is input to the PDP to when visible light is emitted therefrom. However, the efficiency of energy conversion (i.e., brightness ratio relative to consumed power) in each of these steps is relatively low. The overall energy conversion efficiency of the PDP is, in fact, lower than that of the CRT. Therefore, an important objective pursued by PDP manufacturers is that of enhancing energy conversion efficiency.

In Japanese Laid-Open Patent No. 2000-285814, two problems of the AC-PDP with a triode surface discharge structure are pointed out. The first has to do with varying discharge intensities of the discharge cells. That is, depending on the position of the discharge cells along lines of the same in the direction of the sustain electrodes, the discharge intensities of the discharge cells vary. This results in a brightness over the screen of the PDP that is not uniform.

The second problem of the AC-PDP as indicated in the above-referenced application is that mis-discharge occurs between discharge cells adjacent along the direction the address electrodes are formed. This may result in poor picture quality since unintended phosphor layers are illuminated.

In an effort to overcome these problems, the above-referenced application discloses a configuration in which one scan electrode and two common electrodes are mounted corresponding to each discharge cell. Since two common electrodes are provided for every one scan electrode, a resistance value for a predetermined unit of length of each pair of the common electrodes is double a resistance value for an equal unit of length of each of the scan electrodes.

Each of the scan electrodes in this application includes a transparent electrode and a metal bus electrode to provide a suitable level of conductivity to the transparent electrodes. Similarly, each of the common electrodes includes a transparent electrode and a metal bus electrode to provide a suitable level of conductivity to the transparent electrodes. Further, barrier ribs are formed in a striped pattern parallel to the address electrodes.

However, there are significant drawbacks to such a structure disclosed in Japanese Laid-Open Patent No. 2000-285814. First of all, since the bus electrodes mounted on the scan electrodes and common electrodes are exposed in the areas of discharge, the amount of discharge current flowing through the sustain electrodes is significantly increased. This causes an increase in the amount of power consumed to thereby reduce PDP efficiency, and also acts as a hindrance to realizing uniform brightness in the discharge cells such that overall picture quality is reduced.

Another drawback to the above structure is that limitations are placed on increasing the number of pixels along the direction of the address electrodes by mounting three sustain electrodes for each discharge cell. This limits attempts at enhancing picture quality. Further, if steps are taken to obtain high picture quality using the basic configuration described above, crosstalk occurs between adjacent discharge cells.

Finally, one way in which PDP efficiency is enhanced is to increase the Xe content or the Xe—He compound gas content in the discharge gas. However, with the above electrode structure and particularly the barrier rib structure described above, such a change in the discharge gas makes address discharge and sustain discharge unstable. Therefore, only a very limited effectiveness of altering the discharge gas components is achieved.

SUMMARY OF THE INVENTION

In one exemplary embodiment of the present invention, there is provided a plasma display panel (PDP) that limits a discharge current in discharge cells to thereby prevent an increase in power consumption, and that maximizes illumination efficiency to enhance overall PDP efficiency.

Further, there is provided a PDP in which a pitch between discharge cells along a direction address electrodes are formed is reduced to thereby allow for more pixels to be formed and a higher picture quality to be obtained, and to thereby solve the problem of crosstalk between discharge cells along the direction of the address electrodes.

In an exemplary embodiment of the present invention, a plasma display panel includes a first substrate and a second substrate provided opposing one another with a predetermined gap therebetween; address electrodes formed on a surface of the first substrate opposing the second substrate; barrier ribs mounted in the gap between the first and second substrates, the barrier ribs defining discharge cells; phosphor layers formed within each of the discharge cells; and sustain electrodes formed on a surface of the second substrate opposing the first substrate, the sustain electrodes being formed along a direction substantially perpendicular to the address electrodes. The sustain electrodes include scan electrodes and common electrodes, one scan electrode being formed for each row of the discharge cells formed along the direction substantially perpendicular to the address electrodes, two common electrodes being formed for each row of the discharge cells formed along the direction substantially perpendicular to the address electrodes, and each common electrode being shared among rows of the discharge cells adjacent along the direction the address electrodes are formed. Also, the common electrodes are mounted in areas corresponding to the formation of non- discharge regions formed between the first substrate and the second substrate.

The scan electrodes are formed along areas corresponding substantially to centers of the discharge cells of each row of the discharge cells formed along the direction substantially perpendicular to the address electrodes.

The common electrodes include transparent electrodes, and bus electrodes that are electrically connected to the transparent electrodes. The bus electrodes are formed along areas corresponding to the formation of the barrier ribs. Each of the transparent electrodes extends into areas of the discharge cells of two rows of the discharge cells adjacent along the direction the address electrodes are formed.

In another embodiment, the common electrodes include transparent electrodes, and bus electrodes that are electrically connected to the transparent electrodes, and the bus electrodes are formed along pathways formed between two rows of the discharge cells adjacent along the direction the address electrodes are formed. Here also, each of the transparent electrodes extends into areas of the discharge cells of two rows of the discharge cells adjacent along the direction the address electrodes are formed.

The barrier ribs form the discharge cells into independent structures. The barrier ribs include first barrier rib members substantially parallel to the address electrodes, and second barrier rib members formed along a direction substantially perpendicular to the address electrodes. In one embodiment, a height of the barrier ribs is 90–120 μm.

In yet another embodiment, a plasma display panel includes a first substrate and a second substrate provided opposing one another with a predetermined gap therebetween; address electrodes formed on a surface of the first substrate opposing the second substrate; barrier ribs mounted in the gap between the first and second substrates, the barrier ribs defining discharge cells and non-discharge regions; phosphor layers formed within each of the discharge cells; and sustain electrodes formed on a surface of the second substrate opposing the first substrate, the sustain electrodes being formed along a direction substantially perpendicular to the address electrodes. The non-discharge regions are formed in areas encompassed by discharge cell abscissas that pass through centers of adjacent discharge cells and discharge cell ordinates that pass through centers of adjacent discharge cells. The sustain electrodes include scan electrodes and common electrodes, one scan electrode being formed for each row of the discharge cells formed along the direction substantially perpendicular to the address electrodes, two common electrodes being formed for each row of the discharge cells formed along the direction substantially perpendicular to the address electrodes, and each common electrode being shared among rows of the discharge cells adjacent along the direction the address electrodes are formed. Also, the common electrodes are mounted in areas corresponding to the formation of the non-discharge regions.

Each of the discharge cells is formed such that ends of the discharge cells gradually decrease in width along a direction the discharge sustain electrodes are formed as a distance from a center of the discharge cells is increased along a direction the address electrodes are formed.

Further, a depth at both ends of the discharge cells along the direction of the address electrodes decreases as a distance from a center of the discharge cells is increased.

The barrier ribs include first barrier rib members substantially parallel to the address electrodes, second barrier rib members formed at a predetermined angle to the first barrier rib members, and third barrier rib members formed along a direction substantially perpendicular to the address electrodes.

DETAILED DESCRIPTION

Figure 1:
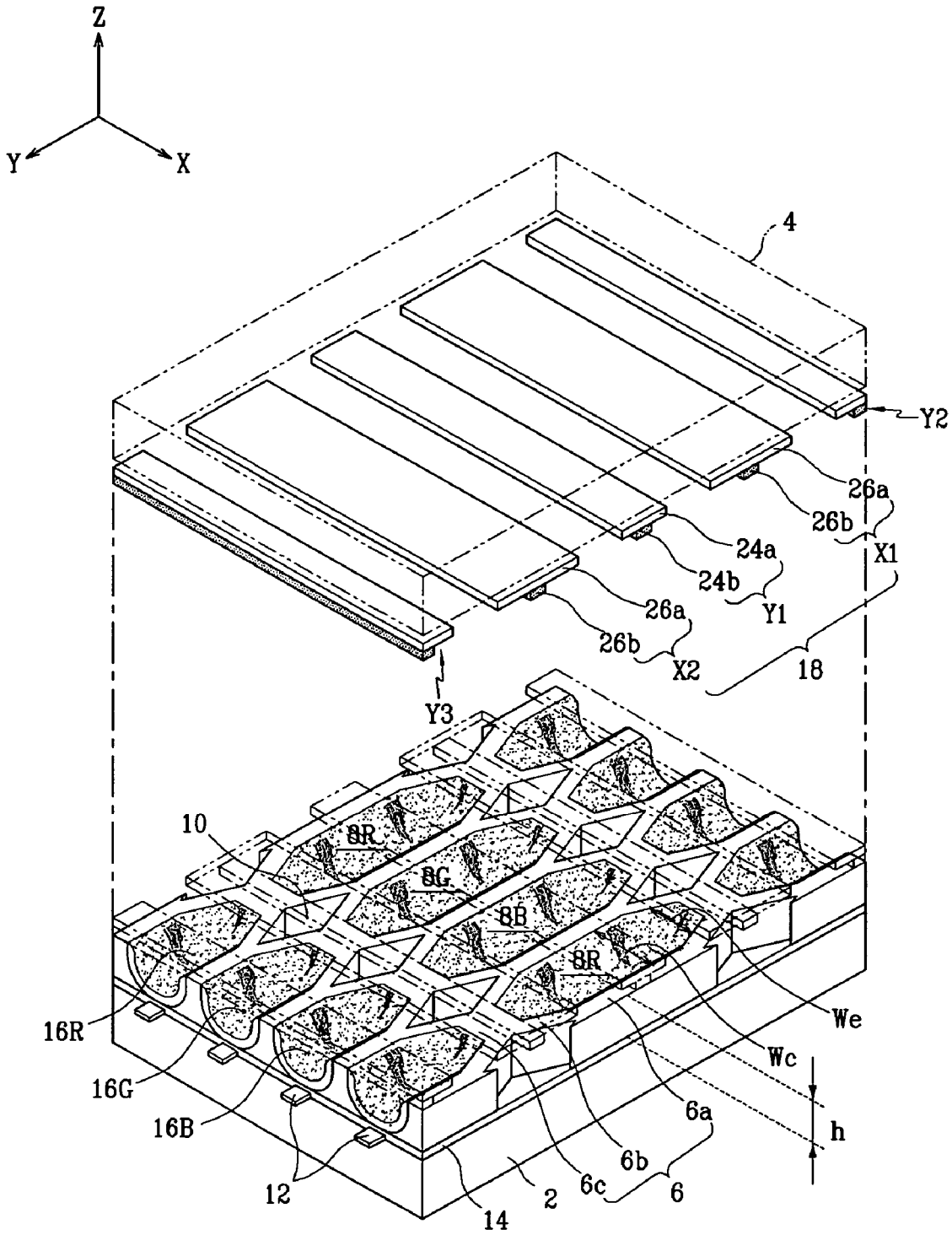
FIG. 1 is a partial exploded perspective view of a plasma display panel according to an exemplary embodiment of the present invention.
Figure 2:
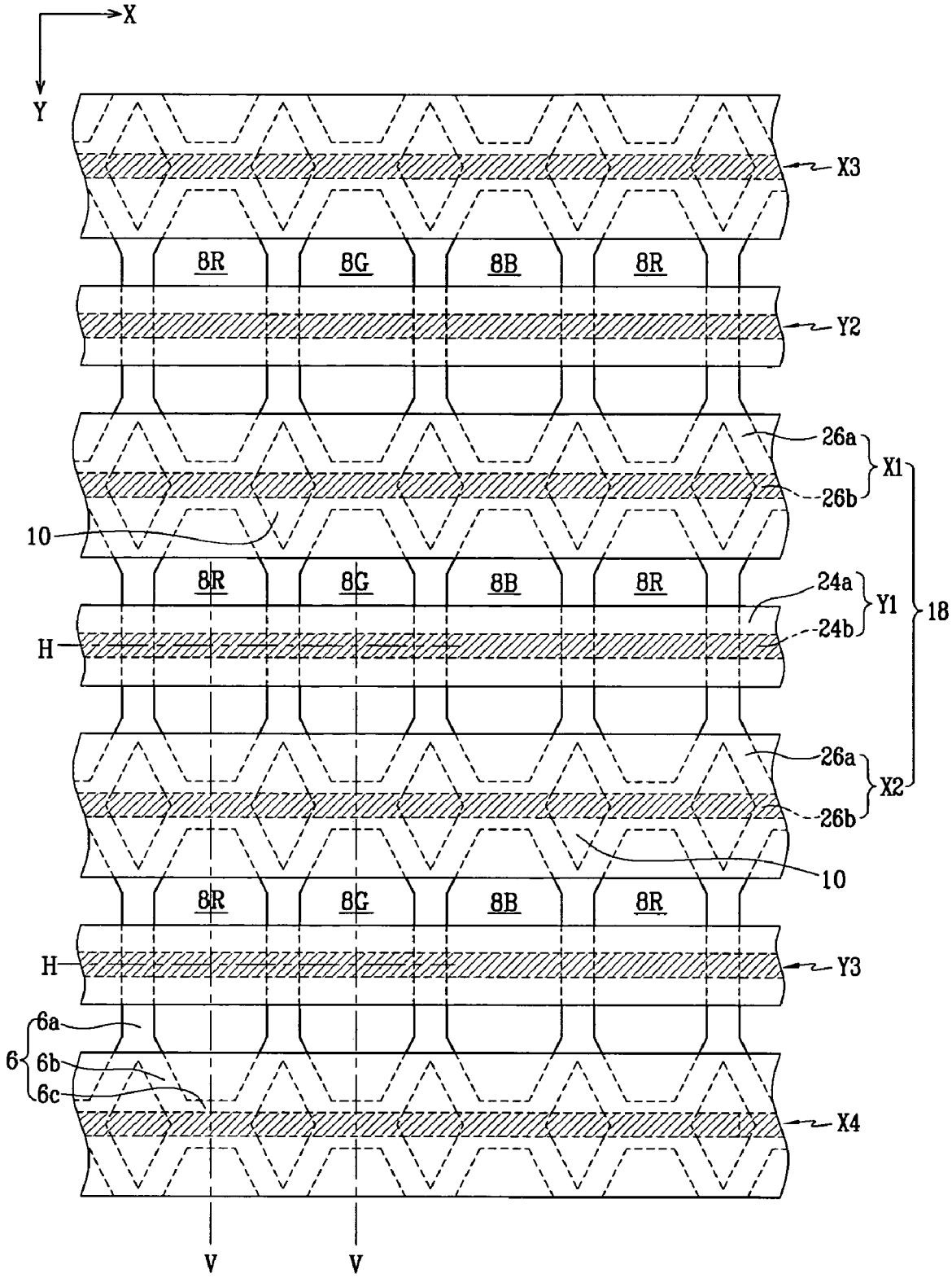
FIG. 2 is a partial plan view of the plasma display panel of FIG. 1 shown in an assembled state.

Referring to FIGS. 1 and 2, a PDP according to an exemplary embodiment of the present invention includes first substrate 2 and second substrate 4 provided opposing one another with a predetermined gap therebetween. Non-discharge regions 10 and discharge cells 8R, 8G, 8B are defined by barrier ribs 6 formed between first substrate 2 and second substrate 4. A discharge gas (an Ne—Xe compound gas) is filled in discharge cells 8R, 8G, 8B.

A plurality of address electrodes 12 is formed along one direction (direction Y in the drawings) on a surface of first substrate 2 opposing second substrate 4. As an example, address electrodes 12 are formed in a striped pattern with a uniform, predetermined interval between adjacent address electrodes 12. First dielectric layer 14 is formed over the entire surface of first substrate 2 covering address electrodes 12.

Barrier ribs 6 are mounted on first dielectric layer 14 to define non-discharge regions 10 and discharge cells 8R, 8G, 8B as described above. Discharge cells 8R, 8G, 8B designate areas in which discharge gas is provided and where gas discharge is expected to take place with the application of an address voltage and a discharge sustain voltage. Non-discharge regions 10 are areas where a voltage is not applied such that gas discharge (i.e., illumination) is not expected to take place therein. In this exemplary embodiment, non-discharge regions 10 and the discharge cells 8R, 8G, 8B are formed into independent cell structures.

Barrier ribs 6 define discharge cells 8R, 8G, 8B in a direction of address electrodes 12 (direction Y), and in a direction substantially perpendicular to the direction the address electrodes 12 are formed (direction X). Discharge cells 8R, 8G, 8B are formed in a manner to optimize gas diffusion. This is realized by reducing a size of discharge cells 8R, 8G, 8B in areas that minimally affect sustain discharge and brightness. In particular, each of the discharge cells 8R, 8G, 8B is formed with ends that reduce in width along direction X as a distance from a center of each of the discharge cells 8R, 8G, 8B is increased in the direction address electrodes 12 are formed (direction Y). That is, as shown in FIG. 1, width Wc of a mid-portion of discharge cells 8R, 8G, 8B is greater than width We of the ends of discharge cells 8R, 8G, 8B, with width We of the ends decreasing up to a certain point as the distance from the center of discharge cells 8R, 8G, 8B is increased. Therefore, the ends of discharge cells 8R, 8G, 8B are formed in the shape of a trapezoid (with its base removed) until reaching a predetermined location where barrier ribs 6 close off discharge cells 8R, 8G, 8B. This results in each of the discharge cells 8R, 8G, 8B having an overall planar shape of an octagon.

Non-discharge regions 10 are formed (i.e., defined by barrier ribs 6) in areas encompassed by discharge cell abscissas H and ordinates V (see FIG. 2) that pass through centers of each of the discharge cells 8R, 8G, 8B, and that are respectively aligned with direction X and direction Y. In one embodiment, non-discharge regions 10 are centered between adjacent abscissas H and adjacent ordinates V. Stated differently, in one embodiment, each pair of discharge cells 8R, 8G, 8B adjacent to one another along direction X has a common non-discharge region 10 with another such pair of the discharge cells 8R, 8G, 8B adjacent along direction Y. With this configuration realized by barrier ribs 6, each of the non-discharge regions 10 has an independent cell structure.

Barrier ribs 6 defining non-discharge regions 10 and discharge cells 8R, 8G, 8B in the manner described above include first barrier rib members 6*a* that are parallel to address electrodes 12, second barrier rib members 6*b* that form the decreasing formation of the ends of discharge cells 8R, 8G, 8B as described above and so are oblique to the address electrodes 12, and third barrier rib members 6*c* that are formed substantially perpendicular to address electrodes 12 to interconnect adjacent ends of the second barrier rib members 6*b* of the corresponding discharge cell 8R, 8G, 8B. Second barrier rib members 6*b* are formed extending up to a point at a predetermined angle to first barrier rib members 6*a*, and distal ends of the second barrier rib members 6*b* are connected by third barrier rib members 6*c*. There is no separation between the third barrier rib members 6*c* of discharge cells 8R, 8G, 8B adjacent along direction Y. Therefore, second barrier rib members 6*b* and third barrier rib members 6*c* are formed in substantially an X shape between discharge cells 8R, 8G, 8B adjacent along the direction of address electrodes 12.

Red (R), green (G), and blue (B) phosphors are deposited within discharge cells 8R, 8G, 8B to form phosphor layers 16R, 16G, 16B, respectively.

Figure 3:
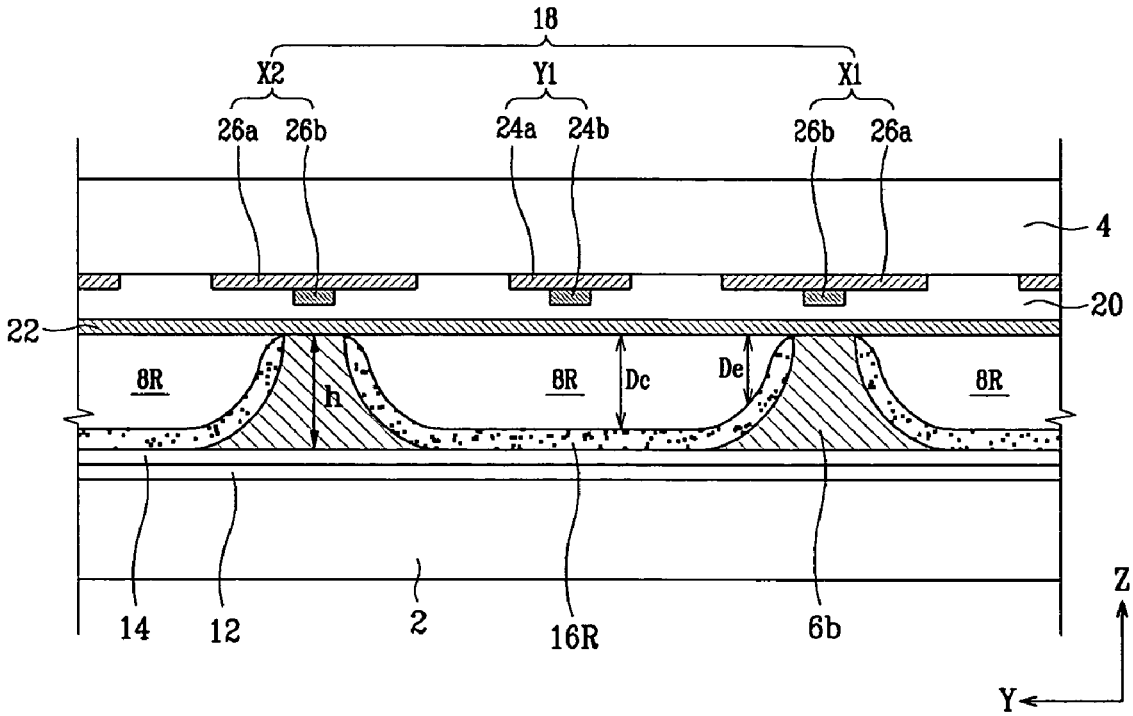
FIGS. 3 and 4 are partial sectional views of the plasma display panel of FIG. 1 shown in an assembled state.

With reference to FIG. 3, a depth at both ends of discharge cells 8R along the direction of the address electrodes 12 decreases as the distance from the center of discharge cells 8R is increased. That is, depth De at the ends of discharge cells 8R is less than depth Dc at the mid-portions of discharge cells 8R, with depth De decreasing as the distance from the center is increased along direction Y. Such a configuration is applied also to discharge cells 8G, 8B of the other colors.

Referring now to FIGS. 1, 2, and 3 with respect to second substrate 4, a plurality of sustain electrodes 18 is formed on the surface of second substrate 4 opposing first substrate 2. Sustain electrodes 18 are formed along a direction (direction X) substantially perpendicular to the direction of address electrodes 12. Second dielectric layer 20 and MgO protection layer 22 are formed over an entire surface of second substrate 4 covering sustain electrodes 18.

Sustain electrodes 18 include scan electrodes (Yn, n=1, 2, 3 . . . ) that operate together with address electrodes 12 to select the discharge cells 8R, 8G, 8B, and common electrodes (Xn, n=1, 2, 3 . . . ) that operate together with scan electrodes Yn to initiate and sustain discharge in discharge cells 8R, 8G, 8B. Scan electrodes Yn are comprised of transparent electrodes 24*a* having a high level of light transmissivity, and bus electrodes 24*b* formed on transparent electrodes 24*a*. Similarly, common electrodes Xn are comprised of transparent electrodes 26*a* having a high level of light transmissivity, and bus electrodes 24*b* formed on the transparent electrodes 26*a*.

Using one row of discharge cells 8R, 8G, 8B formed along the direction substantially perpendicular to address electrodes 12 as an example, the exemplary embodiment of the present invention is structured such that one of the scan electrodes Yn is formed over center areas of discharge cells 8R, 8G, 8B of the particular row of the same. Also, two common electrodes Xn are formed along opposite ends of discharge cells 8R, 8G, 8B of the particular row of the same. Such a configuration is repeated for each of the rows of discharge cells 8R, 8G, 8B. Therefore, for each row of discharge cells 8R, 8G, 8B, one of the scan electrodes Yn is positioned between two of the common electrodes Xn. Furthermore, common electrodes Xn are positioned and sized such that one of the common electrodes Xn is shared among rows of discharge cells 8R, 8G, 8B adjacent along the direction of the address electrodes as shown in FIG. 2.

To provide further explanation with reference to FIG. 2, the depicted middle row of discharge cells 8R, 8G, 8B has formed scan electrode Y1 extending over middle regions of discharge cells 8R, 8G, 8B. Common electrode X1 is formed along one of the two ends of discharge cells 8R, 8G, 8B of the middle row of the same, and common electrode X2 is formed along the other of the two ends of discharge cells 8R, 8G, 8B of the middle row of the same. In addition, common electrode X1 is shared between this middle row of discharge cells 8R, 8G, 8B, and the row of discharge cells 8R, 8G, 8B adjacent to the ends of the middle row of discharge cells 8R, 8G, 8B that common electrode X1 covers. Similarly, common electrode X2 is shared between this middle row of discharge cells 8R, 8G, 8B, and the row of discharge cells 8R, 8G, 8B adjacent to the ends of the middle row of discharge cells 8R, 8G, 8B that the common electrode X2 covers.

The above configuration of sharing common electrodes Xn is made possible by the fact that a substantially identical voltage is applied to all of the common electrodes Xn.

Discharge is sustained in discharge cells 8R, 8G, 8B if a sustain voltage Vs is applied to the corresponding scan electrodes Yn.

In one embodiment, two of the transparent electrodes 26*a* of common electrodes Xn are provided for each row of discharge cells 8R, 8G, 8B as described above. In the embodiment, bus electrodes 26*b* of common electrodes Xn extend across areas corresponding to third barrier rib members 6*c* and non-discharge regions 10 between adjacent rows of discharge cells 8R, 8G, 8B. This prevents low-resistance bus electrodes 26*b* from being positioned in areas where discharge takes place to thereby limit the flow of discharge current. Therefore, an increase in power consumption is prevented, and a reduction in voltage of the common electrodes Xn is minimized. This latter effect results in a more even brightness.

With the configuration described above, if an address voltage Va is applied between one of the address electrodes 12 and one of the scan electrodes Y1 of a particular discharge cell (for example, one of the green discharge cells 8G of FIG. 2), address discharge occurs in discharge cell 8R. The address discharge causes wall charges to be accumulated on second dielectric layer 20 covering sustain electrodes 18 to thereby select the discharge cell 8R.

Figure 4:
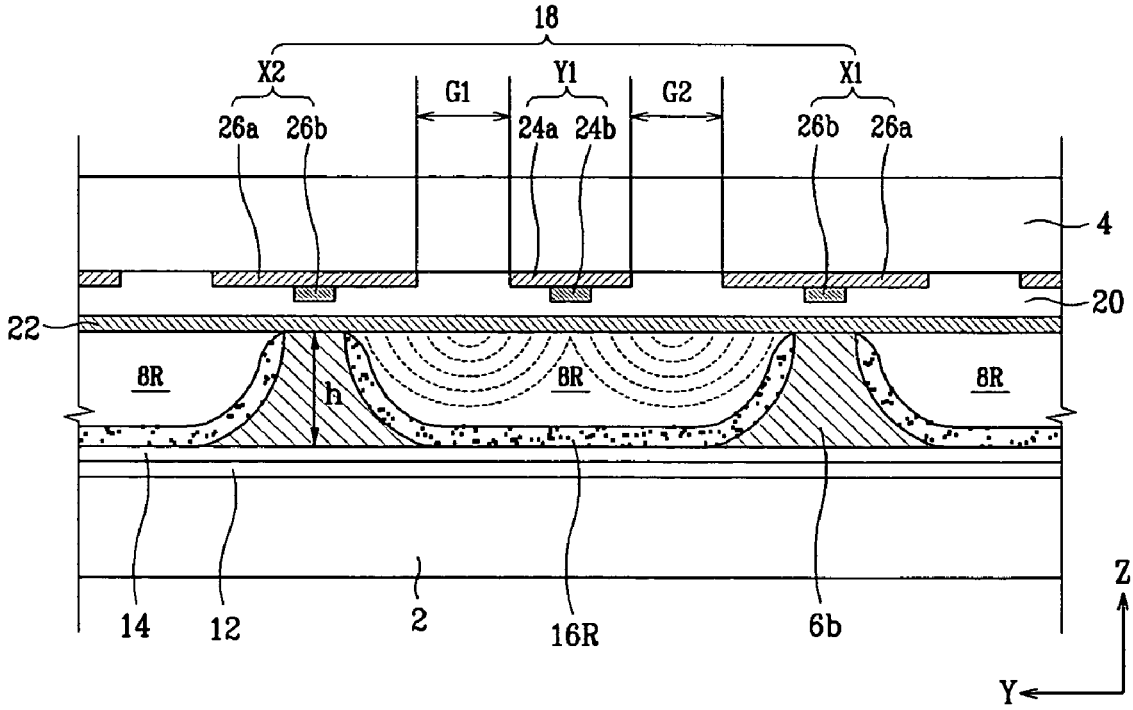

Next, if a sustain voltage Vs is applied to scan electrode Y1 of the selected discharge cell 8R in a state where a ground voltage is applied to common electrodes X1 and X2, discharge is initiated, with reference to FIG. 4, simultaneously in discharge gap G1 between scan electrode Y1 and common electrode X2, and in discharge gap G2 between scan electrode Y1 and common electrode X1. Vacuum ultraviolet rays are emitted from excited Xe atoms, which are created during plasma discharge. The vacuum ultraviolet rays excite phosphor layer 16R such that it emits red visible light. Color images are realized by selectively performing the above operation for all the discharge cells 8R, 8G, 8B.

Plasma discharge generated by the sustain voltage Vs is diffused in approximately an arc shape toward exterior regions of the discharge cell 8R, and is then extinguished. In the exemplary embodiment, each of discharge cells 8R, 8G, 8B is formed to correspond to such diffusion of plasma discharge. Therefore, effective sustain discharge occurs over the entire regions of the discharge cells 8R, 8G, 8B, thereby increasing discharge efficiency.

Further, as a result of the cross-sectional formation of the discharge cells 8R, 8G, 8B as described above with reference to FIG. 3, the area of contact of phosphor layers 16R, 16G, and 16B with discharge areas is increased as exterior regions of discharge cells 8R, 8G, 8B are approached to thereby increase illumination efficiency. Also, non-discharge regions 10 absorb heat emitted from discharge cells 8R, 8G, 8B, and expel this heat to outside the PDP, thereby enhancing the heat discharge characteristics of the PDP.

Furthermore, since discharge is initiated simultaneously in gaps G1 and G2 as described above, the number of discharge paths during sustain discharge is reduced such that height h of barrier ribs 6 may be reduced. In the exemplary embodiment, height h of barrier ribs 6 enabling stable driving is 90–120 μm. By reducing height h of barrier ribs 6, spaces between the address electrodes 12 and the scan electrodes Yn may be reduced. Therefore, a discharge structure that is more advantageous to address discharge is realized.

In the PDP of the exemplary embodiment of the present invention, one scan electrode Yn and a pair of common electrodes Xn are positioned corresponding to each of the discharge cells 8R, 8G, 8B. Further, rows of discharge cells 8R, 8G, 8B adjacent in the direction of address electrodes 12 share one common electrode Xn. This structure of sustain electrodes 18 allows for a pitch between discharge cells 8R, 8G, 8B adjacent in the direction of address electrodes 12 to be reduced. Hence, the number of pixels of the PDP may be increased, resulting in better picture quality.

In addition, second and third barrier rib members 6*b*, 6*c* prevent crosstalk between discharge cells 8R, 8G, 8B adjacent in the direction of address electrodes 12 to thereby stabilize discharge. This allows for the Xe content or the Xe—Ne compound gas content in the discharge gas to be increased so that illumination efficiency is enhanced.

Figure 5:
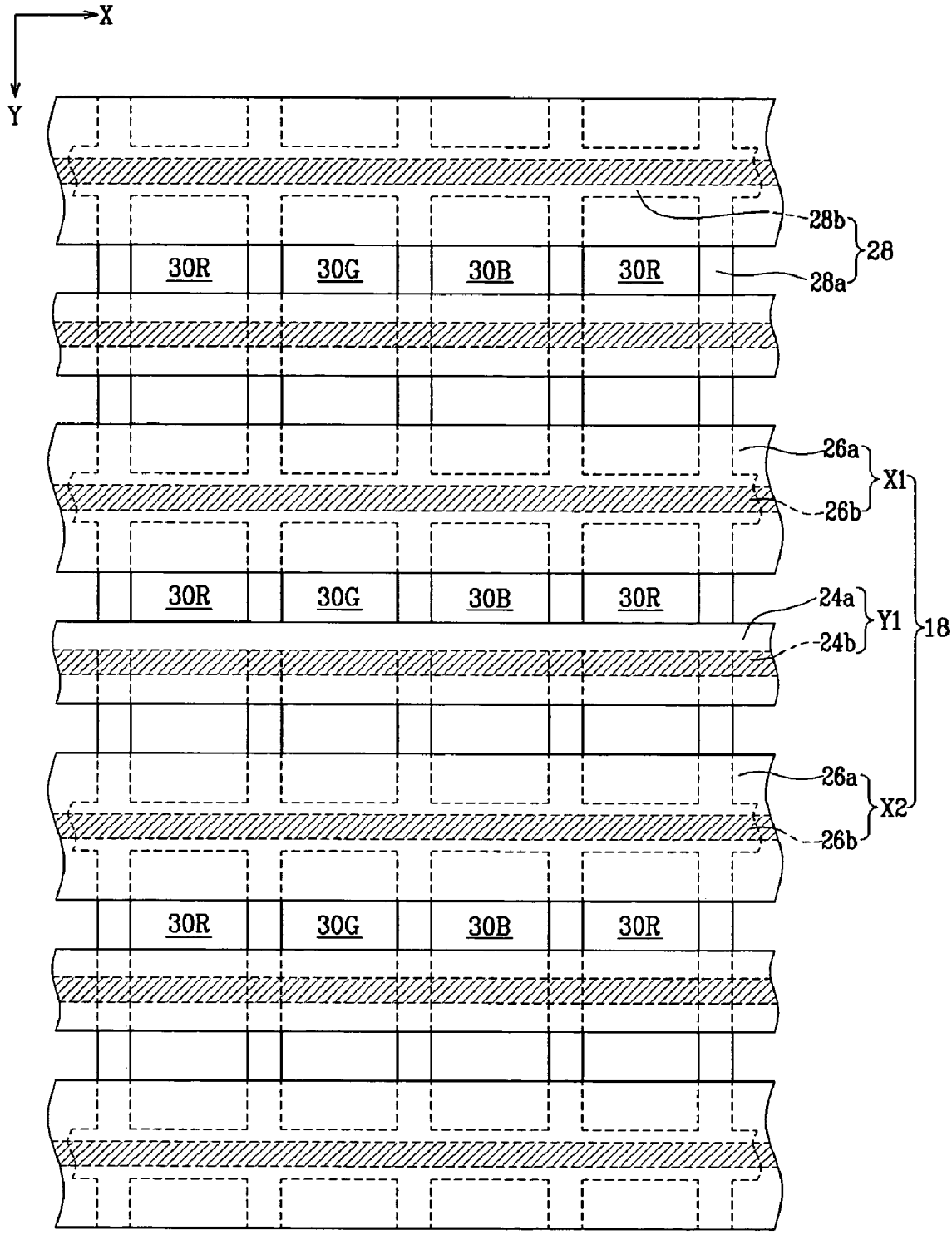
FIG. 5 is a partial plan view of a plasma display panel according to another exemplary embodiment of the present invention.

Additional exemplary embodiments of the present invention will now be described with reference to FIGS. 5 and 6.

The exemplary embodiment shown in FIG. 5 uses the basic structure described with reference to FIGS. 1–4. However, the formation of barrier ribs 28 is altered. In particular, barrier ribs 28 include first barrier rib members 28*a* formed along the direction of address electrodes (not shown), that is, along direction X of FIG. 5. Barrier ribs 28 also include second barrier rib members 28*b* formed substantially perpendicular to first barrier rib members 28*a*, that is, along direction Y. Discharge cells 30R, 30G, 30B are defined into independent cell structures by first and second barrier rib members 28*a*, 28*b* of barrier ribs 28. Bus electrodes 26*b* of common electrodes X1, X2 are formed in areas corresponding to second barrier rib members 28*b* of barrier ribs 28 so that bus electrodes 26*b* are positioned in areas where discharge takes place.

Figure 6:
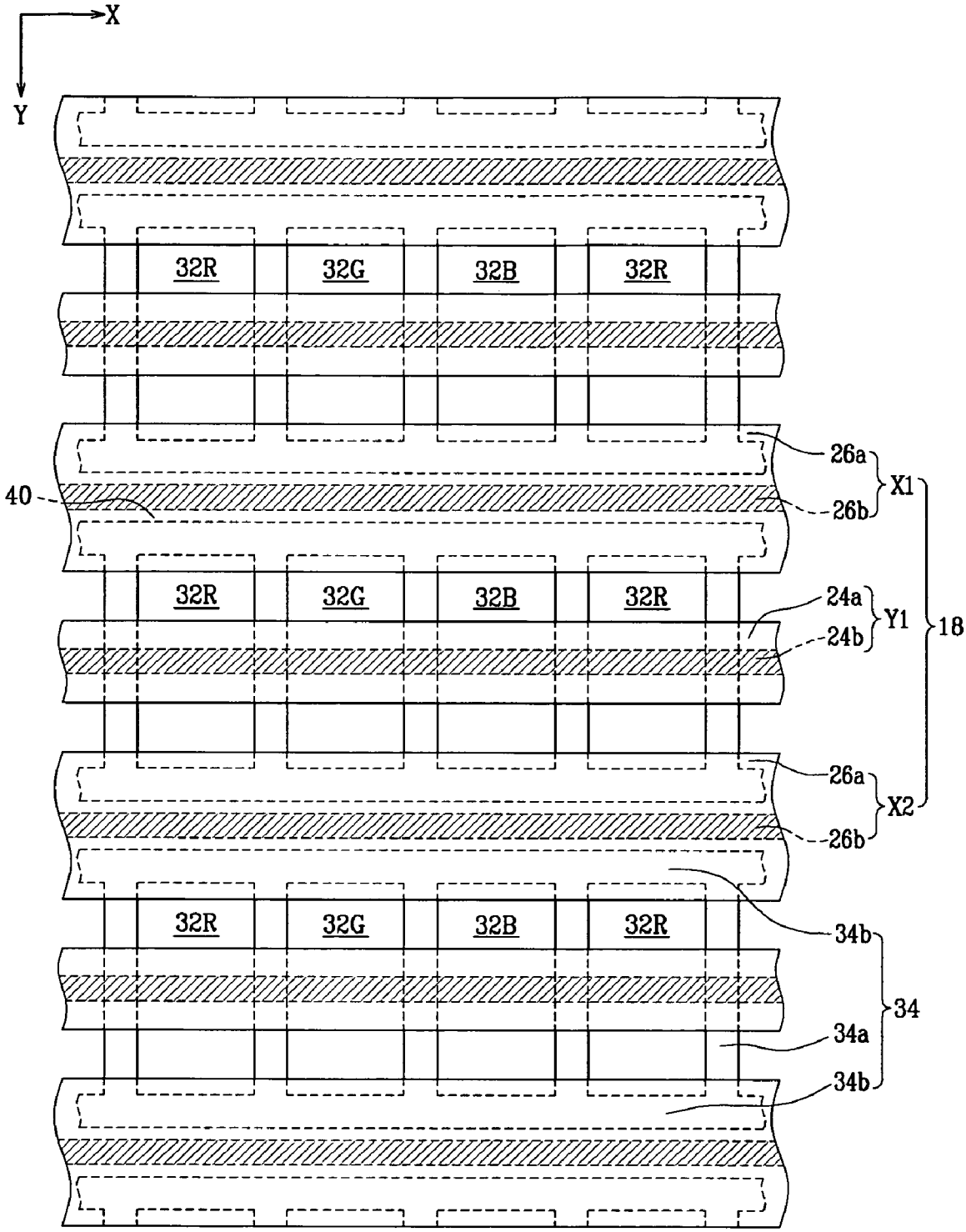
FIG. 6 is a partial plan view of a plasma display panel according to yet another exemplary embodiment of the present invention.

In the exemplary embodiment of FIG. 6 one pathway 40 is formed between adjacent rows of discharge cells 32R, 32G, 32B, in which the rows are formed along a direction substantially perpendicular to a direction address electrodes (not shown) are formed, that is, along direction X.

Barrier ribs 34 of this exemplary embodiment include first barrier rib members 34*a* formed along a direction of address electrodes, that is, along direction Y. Barrier ribs 34 also include second barrier rib members 34*b* formed along a direction substantially perpendicular to the direction of the address electrodes, that is, along direction X, to thereby interconnect ends of first barrier rib members 34*a* adjacent along direction X.

With the formation of pathways 40 as described above, second barrier rib members 34*b* are not shared between adjacent rows of discharge cells 32R, 32G, 32B. Further, bus electrodes 26*b* of common electrodes Xn are formed along areas corresponding to pathways 40 between adjacent rows of discharge cells 32R, 32G, 32B.

In the PDP of the exemplary embodiments of the present invention described above, one scan electrode and a pair of common electrodes Xn are positioned corresponding to each of the discharge cells. Further, rows of the discharge cells adjacent in the direction of the address electrodes share one common electrode. This structure of the sustain electrodes allows for a pitch between the discharge cells adjacent in the direction of the address electrodes to be reduced. Hence, the number of pixels of the PDP may be increased, resulting in better picture quality.

Furthermore, by positioning the bus electrodes in areas outside the discharge cells (i.e., outside areas where discharge takes place), the flow of discharge current is limited such that power consumption is not increased. Also, this allows for a minimization of the voltage of the common electrodes such that brightness is made uniform.

In addition, the barrier ribs independently form each of the discharge cells such that crosstalk between the discharge cells adjacent in the direction of the address electrodes is prevented, thereby making discharge more stable.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A plasma display panel, comprising:

a first substrate and a second substrate provided opposing one another with a predetermined gap therebetween;

address electrodes formed on a surface of the first substrate opposing the second substrate;

barrier ribs mounted in the gap between the first substrate and the second substrate, the barrier ribs defining discharge cells;

phosphor layers formed within each of the discharge cells; and sustain electrodes formed on a surface of the second substrate opposing the first substrate, the sustain electrodes being formed along a direction substantially perpendicular to the address electrodes, wherein the sustain electrodes include scan electrodes and common electrodes, one scan electrode being formed for each row of the discharge cells formed along the direction substantially perpendicular to the address electrodes, two common electrodes being formed for each row of the discharge cells formed along the direction substantially perpendicular to the address electrodes, and each common electrode being shared among rows of the discharge cells adjacent along the direction the address electrodes are formed, wherein the common electrodes are mounted in areas corresponding to the formation of non-discharge regions formed between the first substrate and the second substrate, wherein the scan electrodes are formed along areas corresponding substantially to centers of the discharge cells of each row of the discharge cells formed along the direction substantially perpendicular to the address electrodes, and wherein a single address electrode of said address electrodes corresponds with a scan electrode of said scan electrodes and with a pair of said common electrodes for addressing a discharge cell of said discharge cells.

2. The plasma display panel of claim 1, wherein the common electrodes include transparent electrodes, and bus electrodes that are electrically connected to the transparent electrodes, the bus electrodes being formed along areas corresponding to the formation of the barrier ribs.

3. The plasma display panel of claim 2, wherein each of the transparent electrodes extends into areas of the discharge cells of two rows of the discharge cells adjacent along the direction the address electrodes are formed.

4. The plasma display panel of claim 1, wherein the common electrodes include transparent electrodes, and bus electrodes that are electrically connected to the transparent electrodes, the bus electrodes being formed along pathways formed between two rows of the discharge cells adjacent along the direction the address electrodes are formed.

5. The plasma display panel of claim 4, wherein each of the transparent electrodes extends into areas of the discharge cells of two rows of the discharge cells adjacent along the direction the address electrodes are formed.

6. The plasma display panel of claim 1, wherein the barrier ribs form the discharge cells into independent structures.

7. The plasma display panel of claim 6, wherein the barrier ribs include first baffler rib members substantially parallel to the address electrodes, and second barrier rib members formed along a direction substantially perpendicular to the address electrodes.

8. The plasma display panel of claim 1, wherein a height of the barrier ribs is 90–120 μm.

9. A plasma display panel, comprising:

a first substrate and a second substrate provided opposing one another with a predetermined gap therebetween;

address electrodes formed on a surface of the first substrate opposing the second substrate;

barrier ribs mounted in the gap between the first substrate and the second substrate, the barrier ribs defining discharge cells and non-discharge regions;

phosphor layers formed within each of the discharge cells; and sustain electrodes formed on a surface of the second substrate opposing the first substrate, the sustain electrodes being formed along a direction substantially perpendicular to the address electrodes, wherein the non-discharge regions are formed in areas bounded by discharge cell abscissas and discharge cell ordinates that pass through centers of adjacent discharge cells, and wherein the sustain electrodes include scan electrodes and common electrodes, one scan electrode being formed for each row of the discharge cells formed along the direction substantially perpendicular to the address electrodes, two common electrodes being formed for each row of the discharge cells formed along the direction substantially perpendicular to the address electrodes, and each common electrode being shared among rows of the discharge cells adjacent along the direction the address electrodes are formed, wherein the common electrodes are mounted in areas corresponding to the formation of the non-discharge regions, and wherein a single address electrode of said address electrodes corresponds with a scan electrode of said scan electrodes and with a pair of said common electrodes for addressing a discharge cell of said discharge cells.

10. The plasma display panel of claim 9, wherein each of the discharge cells is formed such that ends of the discharge cells gradually decrease in width along a direction the sustain electrodes are formed as a distance from a center of the discharge cells is increased along a direction the address electrodes are formed.

11. The plasma display panel of claim 9, wherein a depth at both ends of the discharge cells along the direction of the address electrodes decreases as a distance from a center of the discharge cells is increased.

12. The plasma display panel of claim 9, wherein the barrier ribs include first barrier rib members substantially parallel to the address electrodes, second barrier rib members formed at a predetermined angle to the first barrier rib members, and third barrier rib members formed along a direction substantially perpendicular to the address electrodes.

13. The plasma display panel of claim 9, wherein the scan electrodes are formed along areas corresponding substantially to centers of the discharge cells of each row of the discharge cells formed along the direction substantially perpendicular to the address electrodes.

14. The plasma display panel of claim 9, wherein the common electrodes include transparent electrodes, and bus electrodes that are electrically connected to the transparent electrodes, the bus electrodes being formed along areas corresponding to the formation of the non-discharge regions.

15. The plasma display panel of claim 14, wherein each of the transparent electrodes extends into areas of the discharge cells of two rows of the discharge cells adjacent along the direction the address electrodes are formed.

16. The plasma display panel of claim 9, wherein a height of the barrier ribs is 90–120 μm.

* * * * *